US006479937B2

(12) United States Patent
Chen et al.

(10) Patent No.: US 6,479,937 B2
(45) Date of Patent: Nov. 12, 2002

(54) MULTI-BEAM INDEX CRT WITH HORIZONTAL PHOSPHOR LINES

(75) Inventors: Hsing-Yao Chen, Barrington, IL (US); Chun-Hsien Yeh, Taipei (TW)

(73) Assignee: Chunghwa Picture Tubes, Ltd., Yangei (TW)

( * ) Notice: Subject to any disclaimer, the term of this patent is extended or adjusted under 35 U.S.C. 154(b) by 37 days.

(21) Appl. No.: 09/804,901

(22) Filed: Mar. 13, 2001

(65) Prior Publication Data

US 2002/0130622 A1 Sep. 19, 2002

(51) Int. Cl.[7] ..... H01J 29/46
(52) U.S. Cl. ..... 315/14; 313/409
(58) Field of Search ..... 315/14, 365, 368.15, 315/368.16; 313/409, 410

(56) References Cited

U.S. PATENT DOCUMENTS

| | | | | |
|---|---|---|---|---|
| 3,524,094 A | | 8/1970 | Hasker et al. | |
| 3,801,817 A | | 4/1974 | Goodman | 250/365 |
| 4,177,462 A | | 12/1979 | Chung | 340/703 |
| 4,193,071 A | | 3/1980 | Hasegawa et al. | 340/723 |
| 4,225,880 A | | 9/1980 | Goodman | 358/66 |
| 4,234,814 A | | 11/1980 | Chen et al. | 313/412 |
| 4,247,869 A | | 1/1981 | Culter et al. | 358/67 |
| 4,408,223 A | | 10/1983 | Midland | 358/67 |
| 4,439,735 A | | 3/1984 | Avite et al. | 324/404 |
| 4,507,585 A | | 3/1985 | Inoue et al. | 313/471 |
| 4,635,106 A | | 1/1987 | Shinkai | 358/68 |
| 4,701,677 A | | 10/1987 | Ashizaki et al. | 315/382 |
| 5,113,112 A | | 5/1992 | Shimoma et al. | 313/412 |
| 5,389,855 A | * | 2/1995 | Chen | 313/409 |

* cited by examiner

*Primary Examiner*—David Vu
(74) *Attorney, Agent, or Firm*—Emrich & Dithmar

(57) ABSTRACT

A multi-beam color index cathode ray tube (CRT) includes vertically spaced, horizontal phosphor stripes on the inner surface of its display screen. The parallel phosphor bands are arranged in groups of three, with each phosphor stripe in a group providing a respective one of the three primary colors of red, green and blue. An electron gun directs three electron beams onto the display screen, with the three electron beams deflected over the display screen in unison in a raster pattern. The three electron beams are focused in the form of three spots on the display screen, with each spot coincident with a respective horizontal phosphor stripe of a given color. The intensity of each electron beam is independently modulated as it sweeps across the width of the display screen by a respective color video signal in accordance with the displayed image. The three electron beams are each provided with a horizontally elongated cross section, with convergence of the beams provided by a plurality of multi-pole adjustable magnets. By horizontally elongating and vertically offsetting the beams, the vertical spacing between the electron beams as well as between the horizontal phosphor stripes may be reduced for improved video image resolution. The closely spaced electron beams may be focused with a conventional main focusing lens employing a common beam-passing aperture, with electron beam alignment with the horizontal phosphor stripes provided via a beam responsive UV emitter/sensor combination and feedback control arrangement.

21 Claims, 5 Drawing Sheets

DIGITAL DEFLECTION SIGNAL SOURCE 102
DYNAMIC MAGNETIC CONVERGENCE SIGNAL SOURCE 87
$V_A$ 134 SOURCE
$V_F$ 132 SOURCE
$V_{G2}$ 130 SOURCE
$V_{G1}$ 128 SOURCE

MULTI-BEAM INDEX CRT WITH HORIZONTAL PHOSPHOR LINES

FIELD OF THE INVENTION

This invention relates generally to cathode ray tubes (CRTs) of the beam index-type and is particularly directed to a multi-beam index CRT having horizontal phosphor bands.

BACKGROUND OF THE INVENTION

One common cathode ray tube (CRT) employs a color selection electrode in the form of a thin apertured sheet commonly known as a "shadow mask". The shadow mask is in closely spaced relation to an inner surface of the CRT's glass faceplate which has electron beam sensitive phosphor either in the form of bands or dots disposed thereon. The three electron beams are typically directed through apertures in the shadow mask onto the phosphor screen for emitting the primary colors of red, green and blue which appear in the form of a video image on the faceplate. The apertures in the shadow mask ensure that each beam lands only on its associated color phosphor element to provide a high degree of color purity in the video image. Even with precise alignment between the electron guns, shadow mask and phosphor elements on the display screen, a substantial portion of each electron beam is intercepted by the shadow mask prior to incidents upon the faceplate. For example, the shadow mask typically intercepts and dissipates 80% of the electron beam before it reaches the phosphor screen. This not only limits video image brightness, but also results in heating and expanding of the shadow mask and causes misalignment between the shadow mask apertures and electron beam positions which reduces color purity.

Another approach to CRT design is known as a beam index CRT which eliminates the shadow mask. In a beam index CRT, an electron beam is deflected over phosphor bands or stripes disposed on the inner surface of the CRT's faceplate. The parallel, linear phosphor bands are typically oriented vertically and disposed across the CRT's faceplate in a horizontal direction, which is the same direction as electron beam movement. A sensor in the funnel region provides an index signal whose timing is indicative of the position of the CRT's electron beam relative to the various phosphor bands on the faceplate. Because the index signal is a function of the position of the electron beam relative to the phosphor bands, it is used to control the selection of the input drive signals to the CRT's electron gun for providing a video image component at a predetermined location on the faceplate in accordance with the received video signal.

With the electron beam deflected horizontally across the faceplate and with the phosphor bands oriented generally vertically and disposed in a spaced manner across the faceplate, the electron gun must be turned on and off at precisely the right instant and at a very high frequency. For example, with a horizontal sweep time of 62.4 microseconds and with 400 color pixels for horizontal scan line, or 3×400=1,200 monochrome pixels per line, the electron beam dwell time at each pixel is on the order of 52 nanoseconds. This requires a flat frequency response of almost 100 MHz which is difficult to achieve.

In addition, because the electron beam cannot be instantaneously turned off or on, the beam distribution on a given vertical phosphor band is gaussian. This results in a portion of the electron beam being incident upon portions of the CRT faceplate between adjacent vertical phosphor bands which is nonemissive and results in reduced video image brightness.

Another approach in beam index CRT design employs horizontally aligned phosphor elements arranged in alternating red, green and blue color producing stripes. A single electron beam or three electron beams may be provided for energizing the respective red, green and blue phosphor stripes. To provide satisfactory video image resolution, a large number of thin phosphor stripes must be employed. In a beam index CRT incorporating horizontal phosphor stripes, the vertical position registration of the electron beam must be maintained to within a few mils of its proper position which is centered on the particular phosphor stripe being scanned. An electron beam sensing and feedback control arrangement is typically employed for aligning the electron beam with the phosphor stripe it is scanning. The vertical spacing between adjacent electron beams limits the color convergence of the electron beams which typically require a relatively sophisticated main lens arrangement for converging and focusing the electron beams on the display screen. The use of a single electron beam eliminates the multi-beam convergence problem, but requires a large current in the single electron beam, and three times faster scan rate to cover the three individual color fields.

The present invention overcomes the aforementioned limitations of the prior art by providing a beam index CRT having a plurality of spaced, vertically offset electron beams each adapted to scan a respective horizontally aligned phosphor stripe on the display screen for providing one of the primary colors of a video image. Each of the electron beams is horizontally elongated in cross section, with the scanning beams aligned with the horizontal phosphor stripes by means of an auxiliary deflection coil and beam vertical position feedback control loop combination and with beam color convergence provided by a plurality of adjustable multi-pole magnets.

OBJECTS AND SUMMARY OF THE INVENTION

Accordingly, it is an object of the present invention to provide an improved CRT of the beam index type.

It is another object of the present invention to provide a beam index CRT having a multi-beam electron gun with vertically and horizontally spaced electron beams for simultaneously providing color video information on adjacent, vertically spaced, horizontal scan lines.

A still further object of the present invention is to eliminate the requirement for high frequency ON/OFF cycling of an electron beam in a vertical stripe beam index type of CRT.

Yet another object of the present invention is to provide improved electron beam convergence in a multi-beam index-type color CRT using an open main lens incorporating cylindrical focusing grids.

The present invention contemplates a beam index cathode ray tube (CRT) comprising a display screen having a plurality of vertically spaced, horizontally aligned, parallel linear phosphor stripes disposed on an inner surface thereof; an electron gun including cathode means for providing energetic electrons; a beam forming region (BFR) for forming the energetic electrons into a plurality of spaced electron beams each having a horizontally elongated cross section, wherein one or more of the beams are vertically offset from one another; a high voltage focusing lens disposed intermediate the BFR and the display screen for focusing the electron beams on the display screen in the form of a plurality of vertically offset electron beam spots each disposed on a respective phosphor stripe; and an electromagnetic deflection arrangement disposed intermediate the electron gun and the display screen for deflecting the electron beams over the display screen in a raster pattern, wherein each electron beam is incident upon and each electron beam spot scans a respective phosphor stripe.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
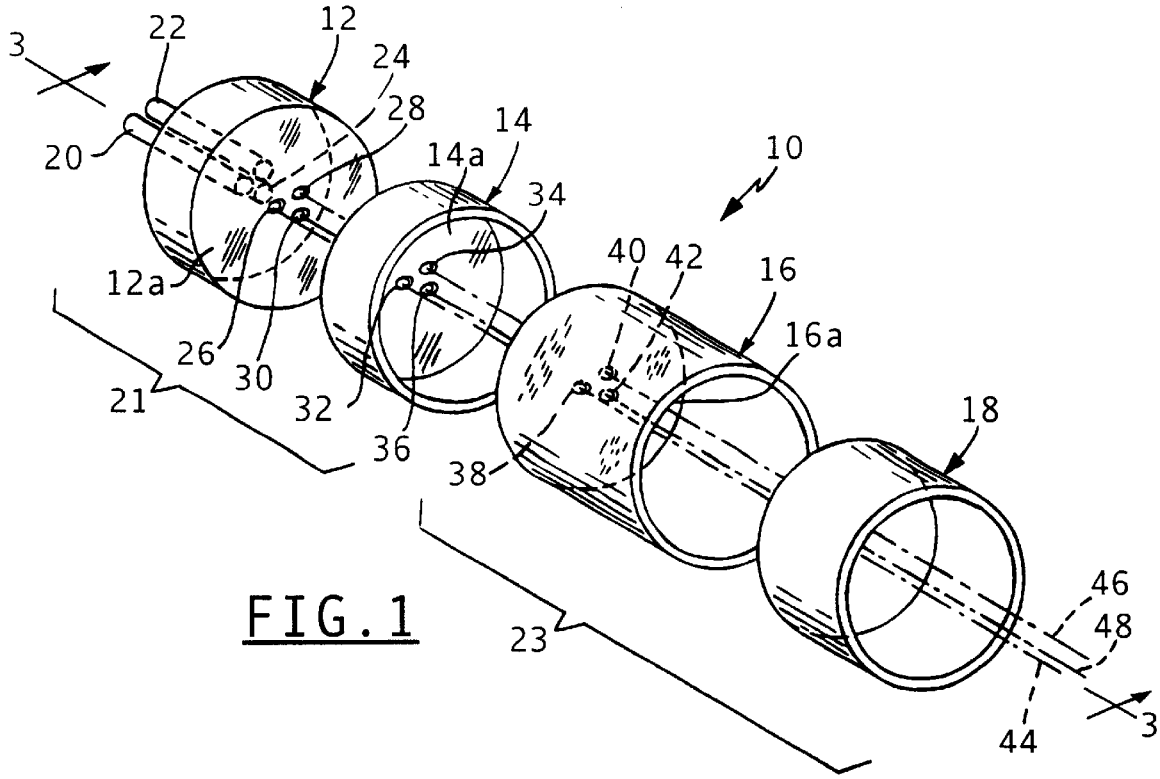
FIG. 1 is a perspective view shown partially in phantom of a bi-potential type electron gun in accordance with one embodiment of the present invention for use in a multi-beam color index CRT.

Referring to FIG. 1, there is shown a perspective view partially in phantom of an electron gun 10 of the bi-potential type in accordance with one embodiment of the present invention. A longitudinal sectional view of the electron gun 10 of FIG. 1 shown with various components of a cathode ray tube (CRT) in which the electron gun is intended for use taken along site line 3—3 in the figure is shown in FIG. 3.

The bi-potential electron gun 10 includes a $G_1$ control grid 12, a $G_2$ screen grid 14, a $G_3$ grid 16 and a $G_4$ grid 18. These grids are sometimes referred to as "electrodes". The $G_1$ control grid 12 and the $G_2$ screen grid 14, in combination, comprise a beam forming region (BFR) 21 of the electron gun 10, while the combination of the $G_3$ grid 16 and the $G_4$ grid 18 forms a main focusing lens 23 of the electron gun.

Electron gun 10 further includes first, second and third cathodes 20, 22 and 24 which are generally cylindrical in shape and are arranged parallel in a generally triangular array along the electron gun's longitudinal axis. Each of the three cathodes 20, 22 and 24 emits a respective plurality of energetic electrons for forming three electron beams 44, 46 and 48 for producing the three primary colors of red, green and blue on the CRT's display screen 58. Disposed on the inner surface of the flat display screen 58 are a plurality of spaced, horizontal stripes of phosphor 60 upon which the three electron beams 44, 46 and 48 are incident. The three electron beams 44, 46 and 48 are generated from the respective pluralities of energetic electrons emitted by the first, second and third cathodes 20, 22 and 24 and are shaped by the electron gun's $G_1$ control grid 12, $G_2$ screen grid 14 and $G_3$ grid 16. The $G_1$ control grid 12 includes an end wall 12*a* at its upper end, or toward the CRT's display screen 58. Disposed in the $G_1$ control grid's end wall 12*a* are three beam-passing apertures 26, 28 and 30 also arranged in a triangular array, with each aperture aligned with a respective electron emitting cathode. Thus, aperture 26 is aligned with cathode 20, aperture 28 is aligned with cathode 22 and aperture 30 is aligned with cathode 24. Disposed in the $G_2$ screen grid 14 in facing relation to the $G_1$ control grid 12 is an end wall 14a which also includes three electron beam-passing apertures 32, 34 and 36 arranged in a generally triangular array. Apertures 32, 34 and 36 in the $G_2$ screen grid 14 are respectively aligned with apertures 26, 28 and 30 in the $G_1$ control grid 12. The $G_3$ grid 16 also includes an end wall 16*a* at its lower end having three beam-passing apertures 38, 40 and 42 arranged in a generally triangular array. Apertures 26, 32 and 38 are in alignment so as to pass the first electron beam 44. Similarly, apertures 28, 34 and 40 and apertures 30, 36 and 42 are in common alignment to respectively pass electron beams 46 and 48.

Figures 3, 4:
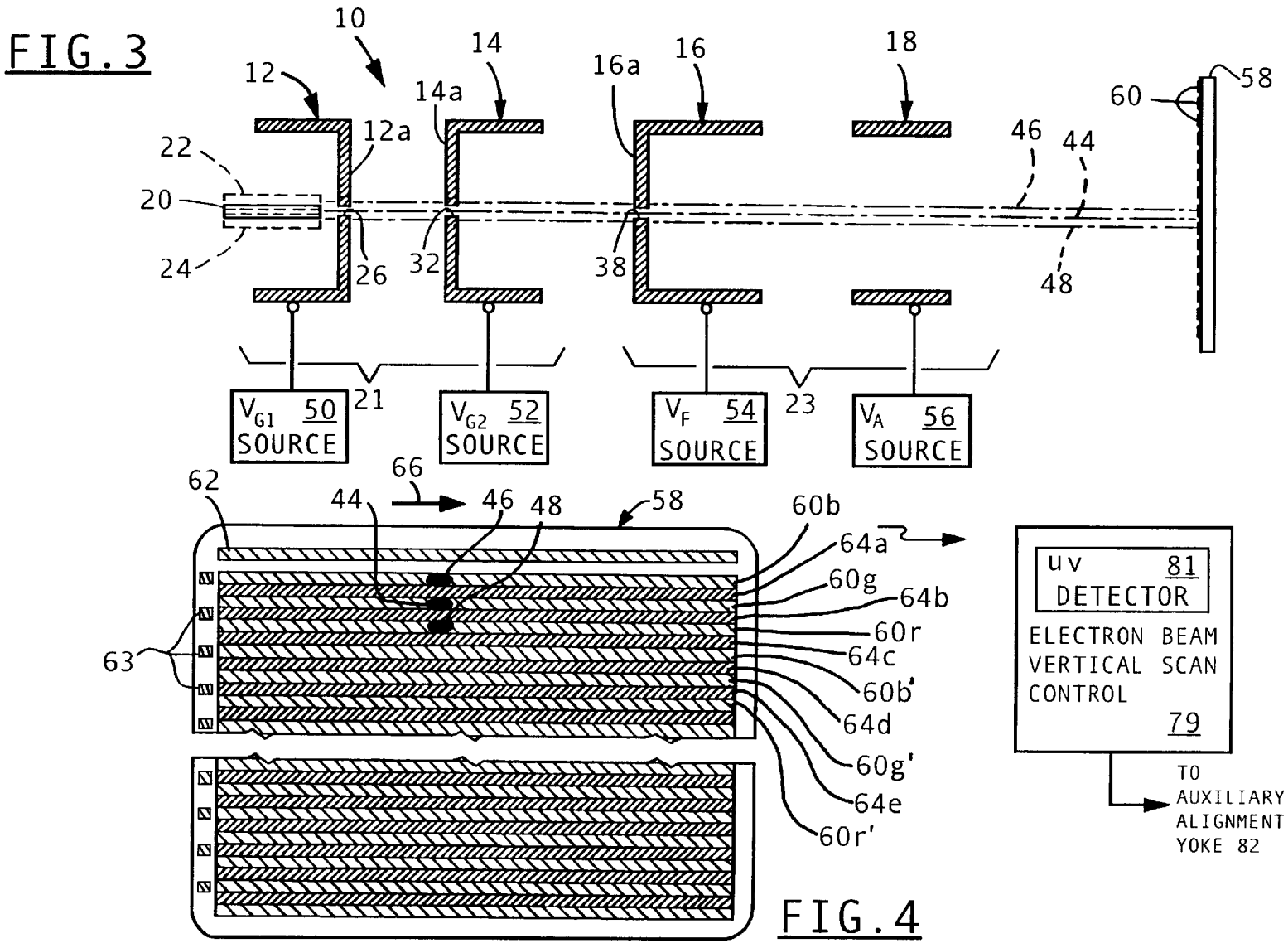
FIG. 3 is a longitudinal sectional view of the electron gun of FIG. 1 taken along site line 3—3 therein.
FIG. 4 is a front elevation view of a multi-beam color index tube display screen showing the horizontal array of phosphor stripes and the manner in which three electron beams scan the phosphor stripes in the multi-beam index CRT in accordance with the present invention.

As shown in FIG. 3, the $G_1$ control grid 20 is coupled to and charged by a $V_{G1}$ voltage source 50, while the $G_2$ screen grid 14 is coupled to and charged by a $V_{G2}$ voltage source 52. Similarly, the $G_3$ and $G_4$ grids 16 and 18 are respectively coupled to and charged by $V_F$ and $V_A$ voltage sources 54 and 56. The $G_1$ control grid 12 is maintained at a relatively low positive voltage for drawing the energetic electrons from the cathodes and provides an initial stage in the forming the electrons into plural beams. The $G_2$ screen grid 14 is typically maintained at a voltage on the order of +1000 V, while the $G_3$ grid 16 is typically maintained at a voltage on the order of +6500 V. Finally, the $G_4$ grid 18 is typically maintained at approximately 25–30 kV.

Figure 2:
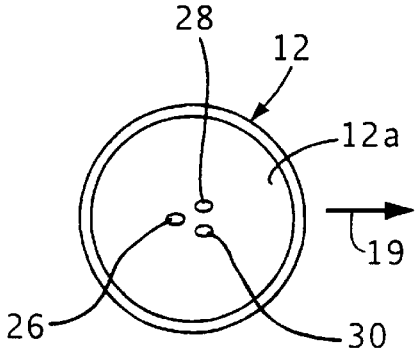
FIG. 2 is a front elevation view of the G1 control grid used in the electron gun of FIG. 1.

As shown in the perspective view of FIG. 1, each of the beam-passing apertures in the $G_1$ control, $G_2$ screen and $G_3$ grids 12, 14 and 16 is horizontally elongated and is generally elliptical in shape. This is particularly shown in the front elevation view of the $G_1$ control grid 12 of FIG. 2 where the three electron beam passing apertures 26, 28 and 30 are shown horizontally elongated with an elliptical cross section. Each electron beam-passing through the respective pluralities of aligned beam-passing apertures in these three grids similarly has a horizontally elongated, elliptical cross-sectional shape. This is shown in the front elevation view of the flat display screen 58 for a beam index tube of FIG. 4. Where the three electron beams directed through beam passing apertures 26, 28 and 30 are swept horizontally in the direction of arrow 19 shown in FIG. 2, a video signal time delay is provided to the electron beam transiting aperture 26 to synchronize the color pixel information in the three electron beams.

Display screen 58 includes a plurality of parallel, horizontally aligned phosphor stripes 60*b*, 60*g*, 60*r*. The letters "b", "g", "r" respectively disignate the three primary colors of blue, green and red, with the phosphor stripes arranged in triad groups where the three electron beams 44, 46 and 48 are respectively incident upon blue, green and red phosphor stripes. Disposed intermediate the blue and green phosphor stripes 60*b* and 60*g* is a first black stripe 64*a* while disposed between the second and third phosphor stripes 60*g* and 60*r* is a second black stripe 64*b*. Black stripes 64*c*, 64*d* and 64*e* are respectively disposed between phosphor stripes 60*r*' and 60*b*', 60*b*' and 60*g*', and 60*g*' and 60*r*'. The black stripes disposed intermediate adjacent phosphor stripes separate the discrete color components of the video image and provide improved video image contrast. Each of the three electron beams 44, 46 and 48 scans a respective color phosphor stripe in the direction of arrow 66 in FIG. 4 until the right-hand edge of the display screen 58 is reached, whereupon the three electron beams are turned off and deflected back to the left for initiating the tracing of the next three lower color phosphor stripes. Also in accordance with the present invention, the vertical dimension of the three color phosphor stripes in each group of phosphor stripes may be of different size. For example, the green producing phosphor stripe may have a greater vertical width than the other two stripes to provide a desired effect such as improved brightness.

Figures 5, 6A, 6B:
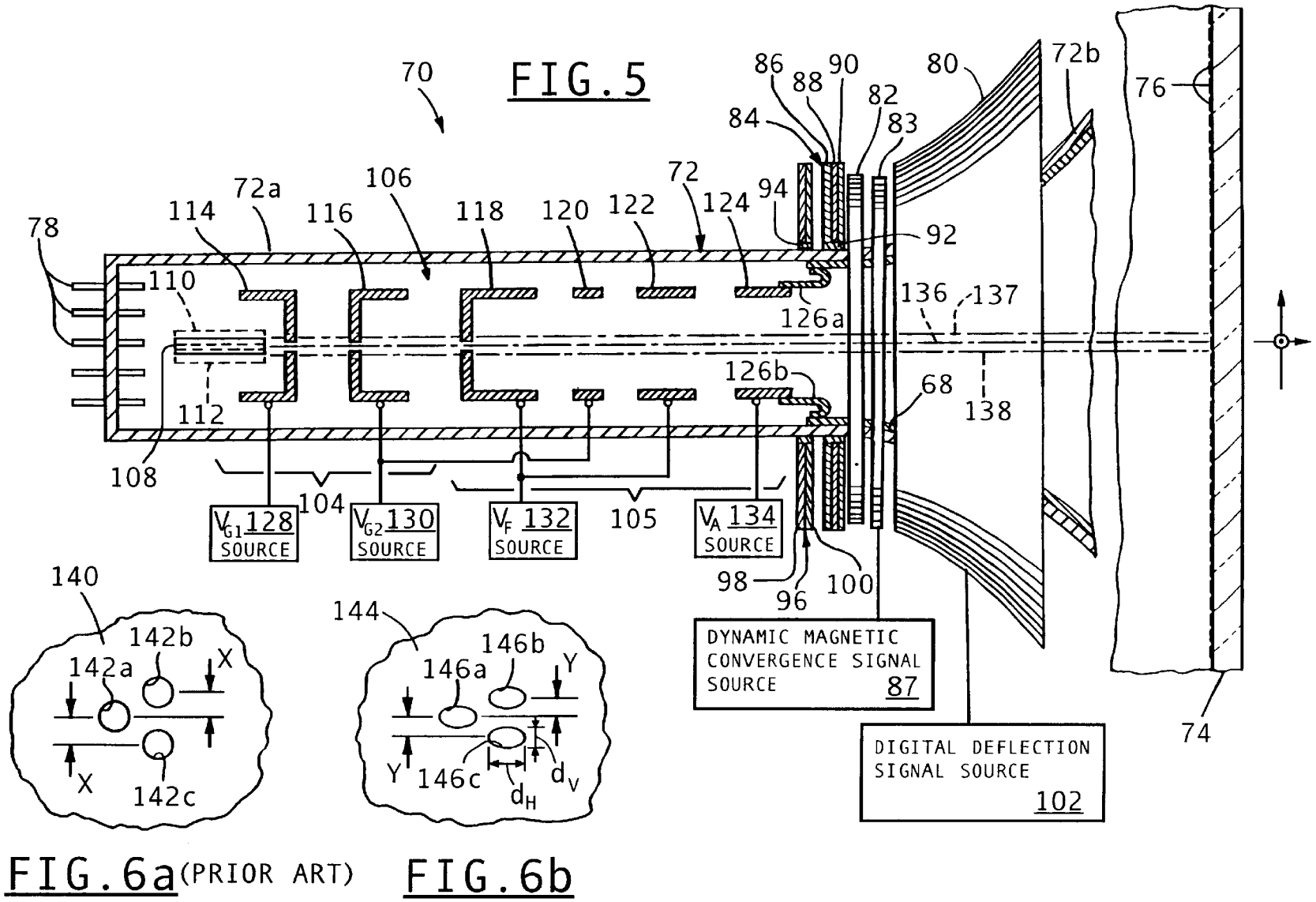
FIG. 6a (PRIOR ART)
FIG. 5 is a partial simplified longitudinal sectional view of a quadruple type electron gun in accordance with another embodiment of the present invention shown in a multi-beam color index CRT.
FIGS. 6*a* and 6*b* are partial elevation views of a $G_1$ control grid respectively illustrating the vertical spacing between circular electron beam-passing apertures as in the prior art and elliptically shaped, horizontally elongated beam-passing apertures within the $G_1$ grid as in one embodiment of the present invention.
Figure 7:
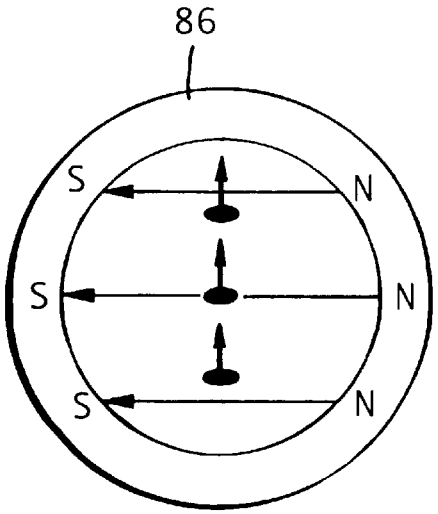
FIGS. 7 is a simplified schematic diagram of a two-pole magnet used in the magnetic convergence arrangement of the CRT shown in FIG. 5 for aligning and converging the three electron beams.
Figure 8A:
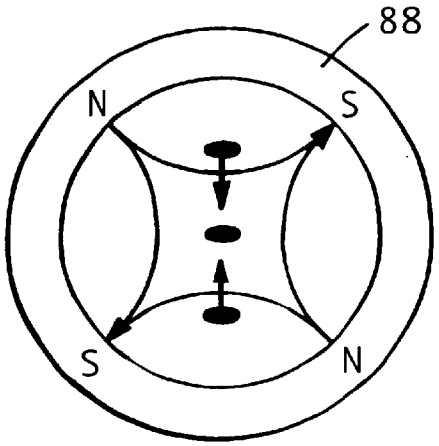
FIGS. 8*a* and 8*b* are simplified schematic diagrams of a four-pole magnet used in the magnetic convergence arrangement of the CRT shown in FIG. 5 for aligning and converging the three electron beams.
Figure 8B:
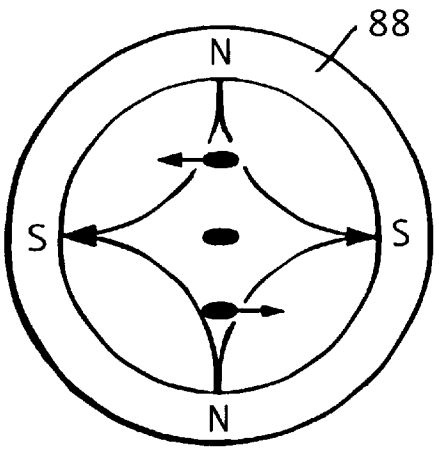
Figure 9A:
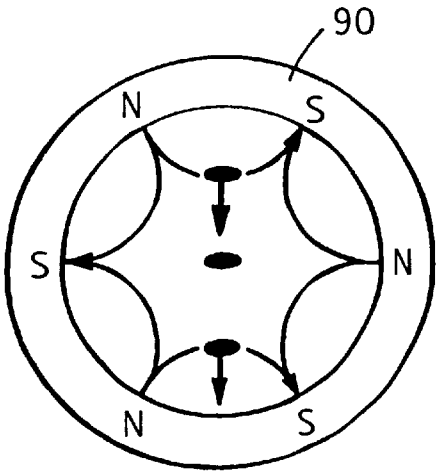
FIGS. 9*a* and 9*b* are simplified schematic diagrams of a six-pole magnet used in the magnetic convergence arrangement in the CRT shown in FIG. 5 for aligning an converging the three electron beams.
Figure 9B:
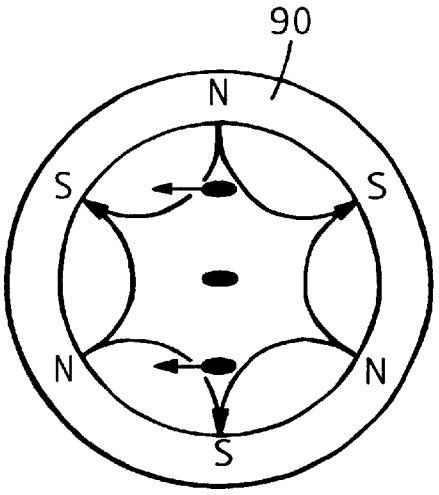

Disposed at the top of display screen 58 is a beam location index line or strip 62. Following retrace of the video display 58 after the three electron beams reach the screen's lower right-hand corner, the beams undergo a retrace and begin scanning the top of the display screen in the direction of arrow 66. In the first horizontal scan of display screen 58, electron beams 46 and 48 are turned off and electron beam 44 is allowed to impinge upon the beam location index stripe 62. In response to incidence of electron beam 44 on the beam location index stripe 62, the beam index stripe outputs a vertical correction signal to an electron beam vertical scan control circuit 79. The electron beam vertical scan control circuit 79, in turn, provides an appropriate output to auxiliary alignment yoke 82 which is shown in FIG. 5 and described in detail below. The auxiliary alignment yoke 82 electromagnetically adjusts for centering electron beam 44 on the beam location index stripe 62. With the relative position of the three electron beams 44, 46 and 48 fixed by the electron gun 10 as well as convergence magnets as described below, centering electron beam 44 on the beam location index stripe 62 ensures that this beam as well as the other two electron beams 46 and 48 are centered on their associated color phosphor stripes as the three beams scan the display screen 58 in a raster-like manner.

Plural beam location index elements 63 may also be provided at the left-hand end of respective phosphor stripes as shown in FIG. 4 to provide an enhanced electron beam alignment capability. In this embodiment, at the start of each horizontal sweep the upper and lower electron beams are turned OFF and the middle electron beam (typically the green electron beam) remains ON as it is directed onto one of the beam location index elements before the electron beams reach the left-hand ends of adjacent phosphor stripes. The beam location index element outputs a vertical correction signal to the electron beam vertical scan control circuit 79 for centering the middle electron beam on the beam location index element. Once the middle electron beam is centered on a beam location index element and as the horizontal sweep of the three electron beams continues, the upper and lower electron beams are turned on as they transit the left-hand end of adjacent horizontal phosphor stripes. The beam location index elements 63*a*–63*d* are contemplated for use in combination with the beam index line 62, with every third horizontal line provided with an associated beam location index element.

Referring to FIG. 5, there is shown a longitudinal sectional view of a color CRT 70 incorporating a quadruple (QPF) electron gun 106 in accordance with another embodiment of the present invention. CRT 70 includes a glass envelope 72 having a cylindrical neck portion 72*a* and a funnel portion 72*b*. CRT 70 further includes a flat glass display screen 74 attached to the larger end of the CRT's funnel portion 72*b*. Disposed on the inner surface of the flat display screen 74 in a spaced manner are a plurality of parallel, horizontally aligned phosphor stripes 76 as described above.

Disposed on the distal end of the CRT's cylindrical neck portion 72*a* are a plurality of conductive stem pins 78 for providing electrical connections for the various components of electron gun 106. Electron gun 106 includes three cathodes 108, 110 and 112 arranged in a triangular array as in the previously described embodiment. The electron gun 106 further includes a beam-forming region (BFR) 104 which includes a $G_1$ control grid 114 and a $G_2$ screen grid 116. The $G_1$ control grid 114 is coupled to and charged by a $V_{G1}$ voltage source 128, while the $G_2$ screen grid 116 is coupled to and charged by a $V_{G2}$ voltage source 130. Electron gun 116 further includes a high voltage focusing lens 105 which includes a $G_3$ grid 118, a $G_4$ grid 120, a $G_5$ grid 122 and a $G_6$ grid 124. The $G_3$ and $G_5$ grids 118, 122 are coupled to and charged by a $V_F$ voltage source 132, while the $G_4$ grid is coupled to and charged by the $V_{G2}$ voltage source 130. The $G_6$ grid 124 is coupled to and charged by a high voltage $V_a$ source 134. Electron gun 106 directs three focused electron beams 136,137 and 138 on the horizontal phosphor stripes 76 on the inner surface of the CRT's display screen 74.

Disposed about the funnel portion 72*b* of the CRT's glass envelope 72 is a magnetic deflection yoke 80 for deflecting the three electron beams 136, 137 and 138 across the inner surface of the display screen 74 in a raster pattern. The magnetic deflection yoke 80 is energized by digital signals provided by a digital deflection signal source 102 for maintaining the electron beams in precise alignment with the spaced horizontal phosphor stripes 76 on the deflection screen's inner surface. The digital signals provided to the magnetic deflection yoke 80 allow for precise control of the horizontal position of the three electron beams as they horizontally scan the display screen 74. Also disposed about the CRT's glass envelope 72 adjacent the intersection of its cylindrical neck portion 72*a* and its funnel portion 72*b* is the auxiliary alignment yoke 82, briefly discussed above. The auxiliary alignment yoke 82 receives inputs from the electron beam vertical scan control 79 which includes a UV detector 81 and receives its input from the beam location index line 62 as shown in FIG. 4 and as described above. The auxiliary alignment yoke 82 insures that each of the three electron beams 136, 137 and 138 is aligned with its associated color phosphor stripe as the electron beams sweep across the width of the display screen 74. Also disposed about the CRT's glass envelope 72 is an auxiliary dynamic magnetic quadruple coil 83 to maintain the three electron beams 136, 137 and 138 in convergence on the display screen 74 or as the beams are displaced over the display screen by the magnetic deflection yoke 80. A dynamic magnetic convergence signal source 102 is coupled to the auxiliary dynamic magnetic quadruple coil 83 for providing an electron beam convergence signal to the quadruple coil to maintain convergence of the electron beams over the entire display screen.

Also disposed about the CRT's glass envelope 72 intermediate the electron gun 106 and the display screen 74 is a multi-polar magnetic alignment arrangement 84. The multi-polar magnetic alignment arrangement 84 is comprised of a two-pole magnet (or dipole) 86, a four-pole magnet (or quadruple) 88 and a six-pole magnet 90. Each of these multi-pole magnets is shown in plan view in FIGS. 7, 8*a* and 8*b*, and 9*a* and 9*b*, respectively. A second multi-pole magnetic alignment arrangement 96 is comprised of a four-pole magnet 98 and a six-pole magnet 100. Each of the aforementioned magnets includes two closely spaced magnetic pole pieces each in the form of a ring shaped, flat disc, although only one such flat disc is shown for each magnet arrangement in the figures for simplicity. The first multi-polar magnetic alignment arrangement 84 is disposed on a first rotating mount 92, while each of the magnets of the second multi-polar magnetic alignment arrangement 96 is disposed on a second rotating mount 94. The first and second rotating mounts 92, 94 permit the magnets attached thereto to be rotationally displaced about the CRT's glass envelope 72 and for the magnetic pole pieces in each magnet to be rotationally displaced relative to one another for adjusting magnetic field strength for aligning the electron beams as described below. Each magnet further includes a tap arrangement for quickly and conveniently increasing or decreasing the field strength of the dipole, quadruple and six-pole magnets in a production line. Such arrangements for adjusting magnetic field strength in a CRT for aligning electron beams are well known to those skilled in the art and are not further discussed herein.

Referring to FIGS. 7, 8*a* and 8*b*, and 9*a* and 9*b*, there are respectively shown elevation views of the two-pole magnet 86, the four-pole magnet 88, and the six-pole magnet 90. The longer arrows within the magnets represent the magnetic field lines, while the shorter arrows represent the force exerted by the magnet on a beam of electrons directed through the magnet. The magnets 86, 88 and 90 may be used in a conventional manner known to those skilled in the art to maintain the various electron beams in proper vertical alignment. Once the beams in the vertical column of electron beams are aligned, horizontal spacing between adjacent beams is provided for by means of the magnets of the second magnetic alignment arrangement 96.

In CRT 70, the $G_1$ control grid 114 and the $G_6$ grid 124 are respectively coupled to a $V_{G1}$ source 128 and a $V_A$ source 134. The $G_6$ grid 124 is engaged by a plurality of conductive positioning/support spacers 126*a* and 126*b* arranged in a spaced manner about the $G_6$ grid for providing support for the electron gun 106 within the CRT's glass envelope 72. Each of the conductive positioning/support spacers 126*a*, 126*b* further engages and is electrically coupled to a conductive layer 68 disposed on the inner surface of the CRT's funnel portion 72*b*. The inner conductive layer 68 is coupled to an anode voltage source (not shown).

Referring to FIG. 6*a*, there is shown a partial elevation view of a prior art arrangement of three electron beam-passing apertures 142*a*, 142*b* and 142*c* arranged in a generally triangular array in the $G_1$ control grid 140 of the electron gun. Each of the three electron beam-passing apertures 142*a*, 142*b* and 142*c* has a generally circular cross-section which provides each of the beams passing through these apertures with a similarly shaped circular cross-section. The vertical spacing between the center of uppermost aperture 142*b* and the center of the intermediate aperture 142*a* is designated as "X". Similarly, the vertical distance between the center of the intermediate aperture 142*a* and the center of the lowermost aperture 142*c* is given by the same distance X. The distance X also represents the vertical distance between the uppermost electron beam and the intermediate electron beam, as well as between the intermediate electron beam and the lowermost electron beam which transit the three apertures shown in FIG. 6*a*.

Referring to FIG. 6*b*, there is shown a partial elevation view of a $G_1$ control grid 144 having a generally triangular array of three beam-passing apertures 146*a*, 146*b* and 146*c* with reduced vertical displacement between these apertures in accordance with the present invention. As shown in FIG. 6*b*, each of the beam-passing apertures 146*a*, 146*b* and 146*c* has a generally elliptical, horizontally elongated cross-section for providing three electron beams each having the same general cross-sectional shape. The vertical spacing between the uppermost elliptical electron beam-passing aperture 146*b* and the intermediate beam-passing aperture 146*a* is given by the distance "Y". Similarly, the vertical distance between the intermediate beam-passing aperture 146*a* and the lowermost beam-passing aperture 146*c* is giving by the same distance Y. The vertical distance between the horizontally elongated, elliptically-shaped electron beams transiting the three apertures 146*a*, 146*b* and 146*c* is similarly given by the distance Y. In comparing FIGS. 6*a* and 6*b*, it can be seen that the elliptical shape of the three beam-passing apertures in $G_1$ control grid 144 allows for a reduced vertical spacing Y between adjacent electron beams relative to the vertical spacing X between adjacent electron beams transiting the generally circular beam-passing apertures in the $G_1$ control grid 140 of the prior art. Also, from FIG. 6, it can be seen that each of the elliptically shaped, horizontally elongated beam-passing apertures 146*a*, 146*b* and 146*c* has a horizontal dimension $d_H$ and a vertical dimension $d_V$. Each of the three beam-passing apertures 146*a*, 146*b* and 146*c* has a characteristic aspect ratio (AR) defined by the ratio of $d_H/d_V$. In a preferred embodiment of the present invention, $1.2 \leqq AR \leqq 3.5$.

Figure 10:
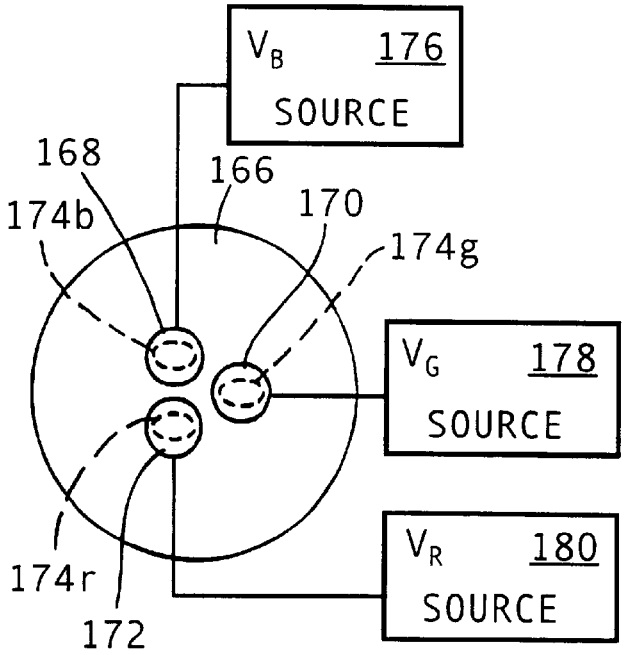
FIG. 10 is an aft plan view of the electron gun of FIG. 1 illustrating the three cathodes in a generally triangular array connected to respective color video signal sources.

Referring to FIG. 10, there is shown an aft view of an electron gun which includes a $G_1$ control grid 166 and three cathodes 168, 170 and 172 arranged in a generally triangular array. Disposed forward of each of the respective cathodes 168, 170 and 172 and within the $G_1$ control grid 166 are three horizontally elongated, generally elliptically-shaped beam-passing apertures 174*b*, 174*g* and 174*r* which are shown in FIG. 10 in dotted line form. Respective electron beams transit apertures 174*b*, 174*g* and 174*r* for generating the primary colors of blue, green and red on the CRT's display screen which is not shown in the figure for simplicity. Respectively coupled to the first, second and third cathodes 168, 170 and 172 are a $V_B$ source 176, a $V_G$ source 178, and a $V_R$ source 180. The $V_B$ source provides appropriate video signals to the first cathode 168 for controlling the blue color generating electron beam. Similarly, the $V_G$ and $V_R$ sources 178, 180 provide respective video signals to the second and third cathodes 170 and 172 for controlling the green and red color generating electron beams.

Figure 11:
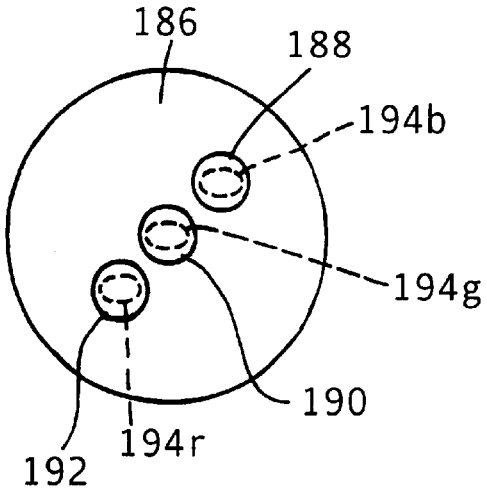
FIG. 11 is an aft view of another embodiment of an electron gun for use in the multi-beam index CRT of the present invention where the three cathodes are shown in an offset, inclined array with the three cathodes vertically and horizontally offset from each other.

Referring to FIG. 11, there is shown an aft view of another embodiment of an electron gun in accordance with the present invention which includes a $G_1$ control grid 186. The $G_1$ control grid 186 includes three beam-passing apertures 194*b*, 194*g* and 194*r* (shown in the figure in dotted line form) for respectively providing the blue, green and red color generating electron beams. The three electron beam-passing apertures 194*b*, 194*g* and 194*r* are linearly aligned and are oriented in an inclined, or oblique, arrangement. Three cathodes 188, 190 and 192 are respectively arranged in alignment with the beam-passing apertures 194*b*, 194*g* and 194*r* for providing energetic electrons which transit the three apertures in the $G_1$ control grid 186. The inclined arrangement of the three beam-passing apertures 194*b*, 194*g* and 194*r* also provides for reduced vertical spacing between these apertures as well as between the three electron beams transiting these apertures.

There has thus been shown a multi-beam color index CRT having a flat display screen with vertically spaced, horizontal phosphor stripes on its inner surface. An electron gun directs three electron beams onto the display screen, with the three electron beams deflected over the display screen in unison in a raster pattern. Each electron beam is independently modulated as it sweeps across the width of the display screen for providing a respective color component of the video image on the display screen. Each electron beam has a horizontally elongated cross-section, with the convergence of the beams provided by a plurality of multi-pole adjustable magnets. By horizontally elongating and vertically offsetting the beam-passing apertures in the beam-forming region of the electron gun, the vertical spacing between the electron beams as well as between the horizontal phosphor stripes on the display screen may be reduced for improved video image resolution. The close spacing of the electron beams also allows for high voltage focusing of the three beams by a conventional main focusing lens employing a common beam-passing aperture. Digital control signals are provided to the CRT's magnetic deflection yoke for precise positioning of the electron beams in scanning the flat display screen, while electron beam alignment with the horizontal phosphor stripes is provided via a beam responsive UF emitter/sensor combination and feedback control arrangement.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A beam index cathode ray tube (CRT) comprising:

a display screen having a plurality of vertically spaced, horizontally aligned, parallel linear phosphor stripes disposed on an inner surface thereof;

an electron gun including:

cathode means for providing energetic electrons;

a beam forming region (BFR) for forming the energetic electrons into a plurality of spaced electron beams each having a horizontally elongated cross section, wherein one or more of said beams are vertically offset from one another;

lens means disposed intermediate said BFR and said display screen for focusing the electron beams on the display screen in the form of a plurality of vertically offset electron beam spots each disposed on a respective phosphor stripe; and electromagnetic deflection means disposed intermediate said electron gun and said display screen for deflecting said electron beams over said display screen in a raster pattern, wherein each electron beam is incident upon and each electron beam spot scans a respective color phosphor stripe.

2. The CRT of claim 1 wherein said phosphor stripes are arranged in groups of three of said stripes, and wherein the three stripes in each group provide the primary colors of red, green and blue.

3. The CRT of claim 2 wherein said BFR forms the energetic electrons into three spaced, vertically offset electron beams, each having an elliptical cross-section.

4. The CRT of claim 1 wherein each phosphor stripe within a group of color phosphor stripes has a given vertical width, and wherein said vertical width varies from stripe to stripe.

5. The CRT of claim 1 further comprising auxiliary deflection means for detecting and adjusting the vertical position of said electron beams in aligning the electron beams with the horizontal phosphor stripes on said display screen.

6. The CRT of claim 5 wherein said auxiliary deflection means includes an auxiliary electromagnetic deflection yoke.

7. The CRT of claim 5 further comprising a lead-in phosphor stripe disposed adjacent an upper edge of said display screen and responsive to an electron beam incident thereon for providing a vertical correction input to said auxiliary deflection means.

8. The CRT of claim 7 further comprising a UV sensor coupled to said auxiliary deflection means and responsive to a UV signal emitted by said lead-in phosphor stripe when an electron beam is incident thereon for providing a vertical correction signal to said auxiliary deflection means.

9. The CRT of claim 5 further comprising plural beam location index elements each disposed adjacent a lateral edge of a respective horizontal phosphor stripe and responsive to an electron beam incident thereon for providing a vertical correction input to said auxiliary deflection means.

10. The CRT of claim 9 further comprising a UV sensor coupled to said auxiliary deflection means and responsive to a UV signal emitted by said beam location index elements when an electron beam is incident thereon for providing a vertical correction signal to said auxiliary deflection means.

11. The CRT of claim 1 wherein said electromagnetic deflection means includes digital means for vertically deflecting said electron beams after each horizontal sweep of said display screen.

12. The CRT of claim 1 wherein said BFR includes a plurality of spaced charged grids each having a plurality of beam-passing apertures, wherein in each of said beam-passing apertures has a horizontally elongated, elliptical cross section, and wherein each aperture is aligned with a corresponding aperture in an adjacent grid.

13. The CRT of claim 1 further comprising a dynamic magnetic quadruple coil disposed intermediate said electron gun and said display screen for converging said plural electron beams on said display screen.

14. The CRT of claim 12 wherein each beam-passing aperture has a horizontal dimension $d_H$ and a vertical dimension $d_v$ defining an aspect ratio (AR), where $AR=d_H/d_V$ and $1.2 \leqq AR \leqq 3.5$.

15. The CRT of claim 12 wherein each grid includes three horizontally elongated apertures each having an elliptical cross-section and wherein the apertures in each grid are arranged in a generally triangular array.

16. The CRT of claim 12 wherein each grid includes three horizontally elongated apertures each having an elliptical cross-section and wherein the apertures in each grid are arranged in an inclined, offset array.

17. The CRT of claim 12 wherein said charged grids include a $G_1$ control grid and a $G_2$ screen grid.

18. The CRT of claim 1 further comprising a plurality of adjustable multi-pole magnets disposed about said CRT intermediate said electron gun and said electromagnetic deflection means for aligning and converging said electron beams in a spaced, generally vertical array on said display screen.

19. The CRT of claim 1 wherein said display screen is substantially flat.

20. The CRT of claim 1 wherein said electron gun is a bi-potential type of electron gun.

21. The CRT of claim 1 wherein said electron gun is a quadruple type of electron gun.

* * * * *